US005326127A

United States Patent [19]

Mercat et al.

[11] Patent Number: 5,326,127

[45] Date of Patent: Jul. 5, 1994

[54] SAFETY BINDING HEELPIECE FOR SKIS

[75] Inventors: Jean-Pierre Mercat, Meythet; Roland Bardin, Varennes Vauzelles; Thierry Wunderlich, Nevers, all of France

[73] Assignee: Look, S.A., Nevers Cedex, France

[21] Appl. No.: 969,166

[22] PCT Filed: Jun. 17, 1992

[86] PCT No.: PCT/EP92/01380

§ 371 Date: Feb. 11, 1993

§ 102(e) Date: Feb. 11, 1993

[87] PCT Pub. No.: WO92/22362

PCT Pub. Date: Dec. 23, 1992

[30] Foreign Application Priority Data

Jun. 19, 1991 [DE] Fed. Rep. of Germany ..... 4120253

[51] Int. Cl.[5] ..... A63C 9/08

[52] U.S. Cl. ..... 280/632

[58] Field of Search ..... 280/631, 632, 626, 623, 280/619, 634

[56] References Cited

U.S. PATENT DOCUMENTS 3,734,520 5/1973 Hashioka ..... 280/632
4,602,804 7/1986 Spitaler et al. ..... 280/632

FOREIGN PATENT DOCUMENTS 2232433 1/1974 Fed. Rep. of Germany ..... 280/632
2628748 12/1977 Fed. Rep. of Germany .
2803647 8/1979 Fed. Rep. of Germany .
2093246 1/1972 France .
481661 1/1970 Switzerland .

*Primary Examiner*—Karin L. Tyson
*Assistant Examiner*—Michael Mar
*Attorney, Agent, or Firm*—Townsend and Townsend Khourie and Crew

[57] ABSTRACT

A heel unit (10) of a safety ski binding comprises a unidirectional blocking arrangement (60') with at least one blocking member (62') arranged between a sole holder (16) and a spring biased return cam (26). The unidirectional blocking arrangement blocks in the opening direction and is releasable against a slight spring force (66) by means of a manual release member (64). One of the return cam (26) and the sole holder (16) is provided with a bearing face (68), generally circular or semicircular and concentric to the axis (A) of the return cam and of the sole holder for the blocking member (62') which is permanently resiliently urged into an actual blocking position.

30 Claims, 11 Drawing Sheets

SAFETY BINDING HEELPIECE FOR SKIS

BACKGROUND OF THE INVENTION

The invention relates to a heel unit for a safety ski binding, comprising a base body intended to be fixed to a ski, a return cam rotatably mounted on the base body about an axis and returned by a spring device into a rotary starting position, a sole holder rotatably mounted about the same axis, and a unidirectional blocking arrangement arranged between the return cam and the sole holder and comprising at least one blocking arrangement, said blocking arrangement being blocked in the opening direction and being releasable against a slide spring force by means of a manual release lever.

Heel units of this kind can be opened for example by means of a manual actuation lever with a minimum effort, by firstly decoupling the sole holder from the spring arrangement which normally urges the sole holder in the closing direction. During such a manual release process, the sole holder can thereby be pivoted into the opening position without having to overcome for this purpose the relatively high return force exerted by the spring arrangement. As soon as the heel unit is closed again and the forced closure is again established between the sole holder and the spring-urged return cam, the heel unit fulfills again the usual holding function and simultaneously allows a reliable safety release.

In a heel unit known from DE 26 28 748 A1, a snap member urged by the spring arrangement engages a slide rail provided with a culminating point, the slide rail being provided on a swing arm concentric to the sole holder. In a starting rotary position corresponding to the closing position, the swing arm and the sole holder contact each other along a circular path eccentric with respect to the pivot axis. A ball lock provided on the swing arm is active between the latter and the sole holder, and locks when the sole holder is urged in the opening direction, provided that the sole holder has already reached its starting rotary position with respect to the swing arm. The ball lock can be released by means of a manual actuation lever.

The drawback of these known heel units is the forced closure necessary between the swing arm and the sole holder for holding the sole until the safety release can no longer be ensured for even small displacements of the starting relative rotary position of these two components of the heel unit. In other words, the ball lock does not block anymore because of the distance which appears between the swing arm and the counter-surface provided on the sole holder. This distance increases as a function of the actual variation of the starting relative rotary position. Consequently, if the sole holder is not completely downwardly engaged, for example because of the formation of ice on the surface of the ski or because of an over-standard sole thickness, it can happen that the required blocking is not guaranteed.

SUMMARY OF THE INVENTION

It is therefore an object of the invention to provide an improved heel unit for a safety ski binding of the kind mentioned at the beginning, which can readily and reliably also always be closed while permitting a manual or arbitrary release with a reduced effort. Thus, the desired return or holding function is ensured, even if the sole holder urged in the closing direction does not reach a predetermined final position, while also ensuring a reliable safety release.

In order to solve this problem, the invention provides that one of the return cam and the sole holder is provided with a bearing face, which is generally circular or semicircular and concentric to the axis of the return cam, and of the sole holder for the blocking member, which is permanently resiliently urged into an actual blocking position between the return cam and the sole holder. The blocking member is supported in a force-locked manner on this bearing face when the sole holder is urged in the opening direction, and permanently engages this bearing face without force transfer when the sole holder is urged in the closing direction, substantially independently of the actual rotary position of the sole holder relative to the return cam, thereby allowing a relative displacement substantially without effort of the sole holder with respect to the return cam in the closing direction.

Owing to the invention, since the circular or semicircular bearing face is made concentric to the axis of the cam and of the sole holder, the blocking member resiliently urged in the actual blocking position independently of the actual relative rotary position of the sole holder with respect to the return cam is constantly in engagement with this face, which ensures the blocking effect. Consequently, the unidirectional blocking arrangement blocks practically immediately in any relative rotary position of the sole holder as soon as the latter is urged in the opening direction.

Hence, the sole holder may not be fully downwardly engaged, for example due to the presence of ice on the surface of the ski or of the sole, or because of an over-standard sole thickness, but the heel unit is capable of perfect operation, i.e. the desired return and holding function as well as case the possibility of a safety release are ensured.

In a respective pivoting of the sole holder in the closing direction, the blocking member slides without force transmission along the circular or semicircular-shaped bearing face, such that the sole holder can be brought into the closing position with a reduced effort when the blocking arrangement is released. Thus, during this closing movement it is not necessary to overcome the relatively high spring force exerted by the spring arrangement. Finally, the arbitrary or manual release requires a reduced effort while avoiding the action of the spring arrangement. For this purpose, it is only necessary to release the blocking member against a low spring force.

Thus, the basic idea of the invention is to design features such that the sole holder can practically freely rotate in the closing direction with respect to the return cam urged by the spring arrangement. In the event of a bias in the opening direction, however, the sole holder is coupled to the spring urged return cam which ensures the return and a safety release immediately and substantially independently of the actual relative rotary position. Owing to this, it is also ensured that the unidirectional blocking arrangement can be released against a low spring force. The arbitrary opening of the heel unit is thus possible only by means of a reduced effort while avoiding the action of the spring arrangement. Finally, the entire stroke of the spring arrangement is always available in the event of a safety release, substantially independently of the actual relative rotary position of the sole holder with respect to the return cam. The desired release characteristic is thereby also maintained, even when the sole holder cannot be fully depressed into its predetermined closing position, for example due to the formation of ice. If the sole holder is prevented from pivoting into its final closing position, for example due to the presence of ice or snow between the ski boot and the ski, and the snow or ice melts during use, the unidirectional blocking arrangement which acts as a free-running drive allows the sole holder to be automatically adjusted in the direction of the predetermined final rotary position due to the pressure of the ski boot without disadjustment of the cam and thus of the release characteristic.

In accordance with another embodiment, the unidirectional blocking arrangement is realized as a friction-type unidirectional blocking arrangement.

In this case, the frictionally-blocking unidirectional blocking arrangement can comprise at least one blocking pawl pivotally mounted on the sole holder and the bearing face is a substantially smooth bearing face provided on the return cam. Alternatively, the frictionally-blocking unidirectional blocking arrangement can be realized in the form of a roller-type unidirectional blocking arrangement which has at least one blocking roller or ball.

When a friction-blocking arrangement comprises a pawl, the blocking pawl is preferably pivotally mounted on the sole holder, and the bearing and sliding face which serves as counter-surface is substantially smooth and provided on the return cam. However, it is also possible to design the heel unit in such a manner that the pivotable blocking pawl is mounted on the return cam and the substantially smooth bearing face which forms the counter-surface is provided on the sole holder. In this case, however, the unidirectional blocking arrangement blocks when the heel unit is biased in the opening direction and allows a free pivoting of the sole holder in the closing direction, in the manner of a free-running drive.

In a further variant, the blocking roller is permanently resiliently urged in an intermediate space which tapers in a wedge-like manner and is guided on a circular track concentric to the axis of the cam and of the sole holder. Therefore, it is ensured that this blocking member is also always maintained in contact with the circular or semicircular bearing face which is also concentric to this axis.

By way of example, the blocking rollers can be made of ceramic material or of steel. In the case of ceramic rollers, only one blocking roller will be generally sufficient, whereas in the case of steel rollers, provision will preferably be made for two blocking rollers opposite to each other or arranged symmetrically. Thereby, one takes into account that ceramic rollers are significantly harder and more resistant than steel rollers, and that it is thus appropriate to distribute the pressure over a higher number of symmetrically arranged rollers, in particular in the case of steel rollers.

In a further variant, the unidirectional blocking arrangement comprises at least one blocking roller and a roller cage rotatably mounted about the axis of the cam and of the sole holder, the roller cage being fixed to the sole holder for rotation therewith. Further, an intermediate space which tapers on one side in a wedge-like manner is formed between the bearing face and a counter-surface provided on the roller cage, and the blocking roller which is guided on a circular track concentric to the axis of the cam and of the sole holder is resilient urgend into the blocking position. forms a kind of free-running drive arrangement between the sole holder and the return cam, which blocks immediately if the sole holder is urged in the opening direction, independently of the actual rotary position of the sole holder, whereas the latter is released in the event of a predetermined bias in the closing direction, applied for example by the ski boot or resulting from a voluntary release of the heel unit. It is important that the roller cage is always rotated together with the sole holder about the axis of the cam and of the sole holder, and that the blocking roller can be displaced with respect to the roller cage, for example for a voluntary release and preferably against a light spring force.

A pawl-type unidirectional blocking arrangement can be used in which the blocking pawl has a tooth and the bearing face of the return cam comprises a toothed sector. As compared to a continuous adjustment and an effectively play-free holding of the ski boot provided by the previous embodiments, a slight play can be observed in this alternative, which corresponds to the pitch of the teeth of the toothed sector, but which is not disadvantageous for most practical applications.

If a manual actuation lever is pivotally mounted on the base body, preferably about the axis of the return can and of the sole holder, the sole holder can be rotated without problem in the opening direction after the unidirectional blocking arrangement has been released. In principle, that the manual actuation lever can also drive the sole holder in the closing direction, and the sole holder is released because the friction-type unidirectional blocking arrangement acts as a free-running drive. In a further variant, the release means provided for the release of the friction-type unidirectional blocking arrangement can be manually actuatable independently of the actuation lever coupled to the sole holder. Thus, the actuation lever can be actuated in the opening direction either in a usual manner against the spring force exerted by the spring arrangement, or by avoiding this spring force when the friction-type unidirectional blocking arrangement is released. A push-button mechanism, an electrically controlled mechanism or the like can be provided to release the friction-type unidirectional blocking arrangement.

Further, the drive of the sole holder by the manual actuation lever can occur in a delayed manner in such a way that at the beginning of the actuation of the lever and before the sole holder is driven, the friction-type unidirectional blocking arrangement is firstly released. In this case it is also possible to allow the release of the friction-type unidirectional blocking arrangement for the opening of the heel unit.

In a further variant with a view to ensuring, on releasing the unidirectional blocking arrangement coupled to the manual actuation lever, that the blocking arrangement also blocks when the lever is not actuated, the manual actuation lever an the sole holder are expediently constantly biased in a starting rotary position in which the friction-type unidirectional blocking arrangement is not yet released.

As an alternative provision can be made for a delayed drive of the sole holder in the opening direction by means of the manual actuation lever. In such an event, the sole holder can also be rotated in the closing direction by means of the manual actuation lever. On driving the sole holder in the opening direction and in the closing direction, the driving member engages thus respectively one of the two opposed limits of the opening through which extends the driving member.

Especially when using a pawl-type blocking arrangement, the respective driving member provided on the manual actuation lever can be used both for driving the sole holder and for releasing the friction-type blocking arrangement.

When using a roller-type unidirectional blocking arrangement, the blocking roller can be advantageously connected to the manual actuation lever and be resiliently maintained by the latter in the actual blocking position. Since the blocking roller is fixed on the manual actuation lever and the latter is able to rotate about the axis of the cam and of the sole holder, it is simultaneously ensured that the blocking roller is guided on a circular track concentric to the bearing and sliding surface and is thus permanently in contact with the counter-surface, or remains at the shortest possible distance from the latter. Here again, an immediate blocking is possible at any time, independently of the actual relative rotary position of the sole holder.

The sole holder can be slightly biased in the opening direction, whereby the sole holder is automatically rotated into the opening position as soon as the friction-type unidirectional blocking arrangement is released. For this purpose, one can for example, provide a spring between the sole holder and the base body.

In a further embodiment, provision is made for a release arrangement associated to the unidirectional blocking arrangement and activated as a function of the rotary position of the sole holder, said unidirectional blocking arrangement being released in a forced manner by this release arrangement when the sole holder reaches a rotary position within a rotation range limited on the one hand by a release position for the ski boot and on the other hand by the opening position. With this arrangement, it can also be ensured that the sole holder is automatically decoupled from the return cam as soon as the sole holder has reached a rotary position such that the ski boot is released, especially during a forward fall in the forward direction. Thus, the return cam can return to its starting rotary position, without driving the sole holder, which facilitates the new introduction into the heel unit.

When the control surface of the spring-urged return cam is realized without a culminating point, the closing of the heel unit can also always occur under a reduced effort by avoiding the relatively high spring force exerted by the spring arrangement. After the ski boot has been released following a safety release, the return cam is immediately returned by the spring arrangement, and the sole holder is returned by means of the return cam. For an arbitrary or manual release it is then necessary to release the unidirectional blocking arrangement acting as a free-running drive, which can be done with a greatly reduced effort. For this purpose, it is sufficient to overcome the light spring force which urges the blocking member. Thereafter, the sole holder can be upwardly pivoted without effort. Also during the closing of the sole holder, an influence of the cam and of the spring arrangement which urges the latter is excluded due to the free-running drive between the sole holder and the cam under the form of the unidirectional blocking arrangement.

In a further variant, the sole holder can be urged in the opening direction by means of a tilting mechanism or the like, whereby the sole holder is automatically brought into its final opening position, after release of the unidirectional blocking arrangement, and is maintained in this position, for example, by means of a light spring force.

As long as the sole holder occupies a rotary position between its closing position and a predetermined intermediate position, the sole holder can also be urged toward the closing position, preferably by means of the same tilting mechanism, which results in an automatic post-adjustment of the heel unit, especially in the event a layer of ice or snow present between the ski boot and the ski becomes thinner, for example under the pressure from vibrations and shocks.

DESCRIPTION OF THE PREFERRED EMBODIMENTS

Figure 1:
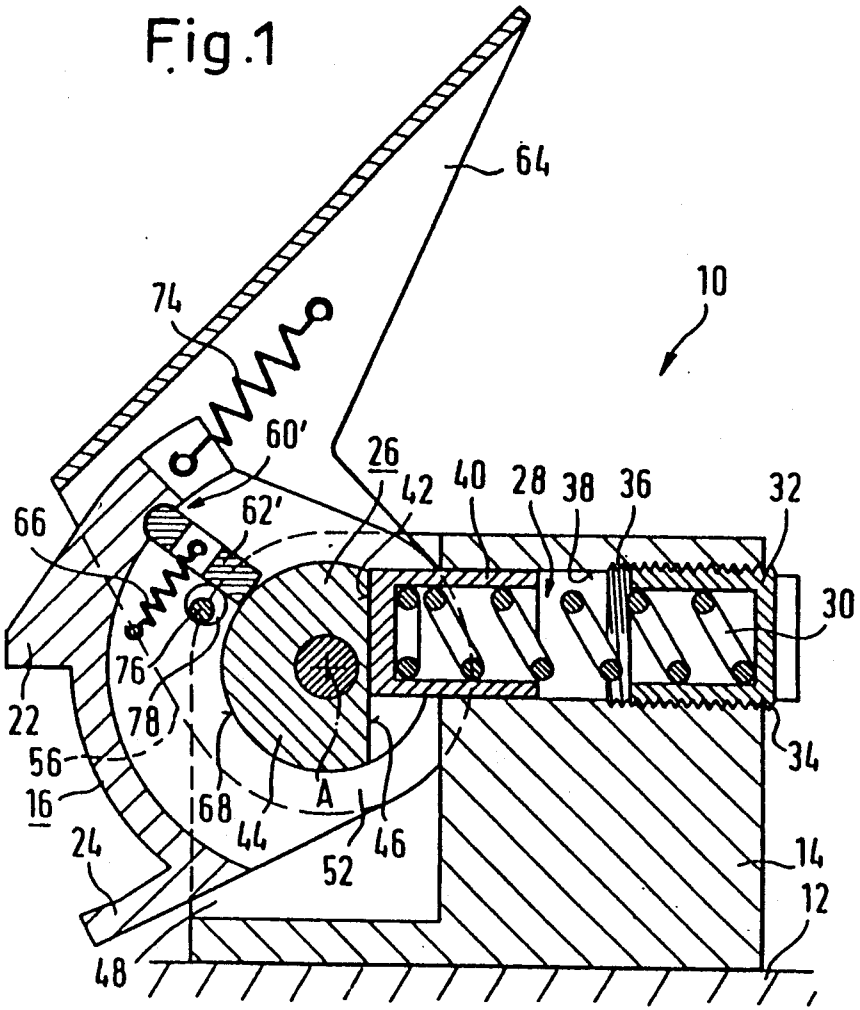
FIG. 1 is a schematic cross-sectional view of a safety heel unit comprising a friction-type unidirectional blocking arrangement under the form of a pawl-type blocking arrangement, in the closing position.
Figure 2:
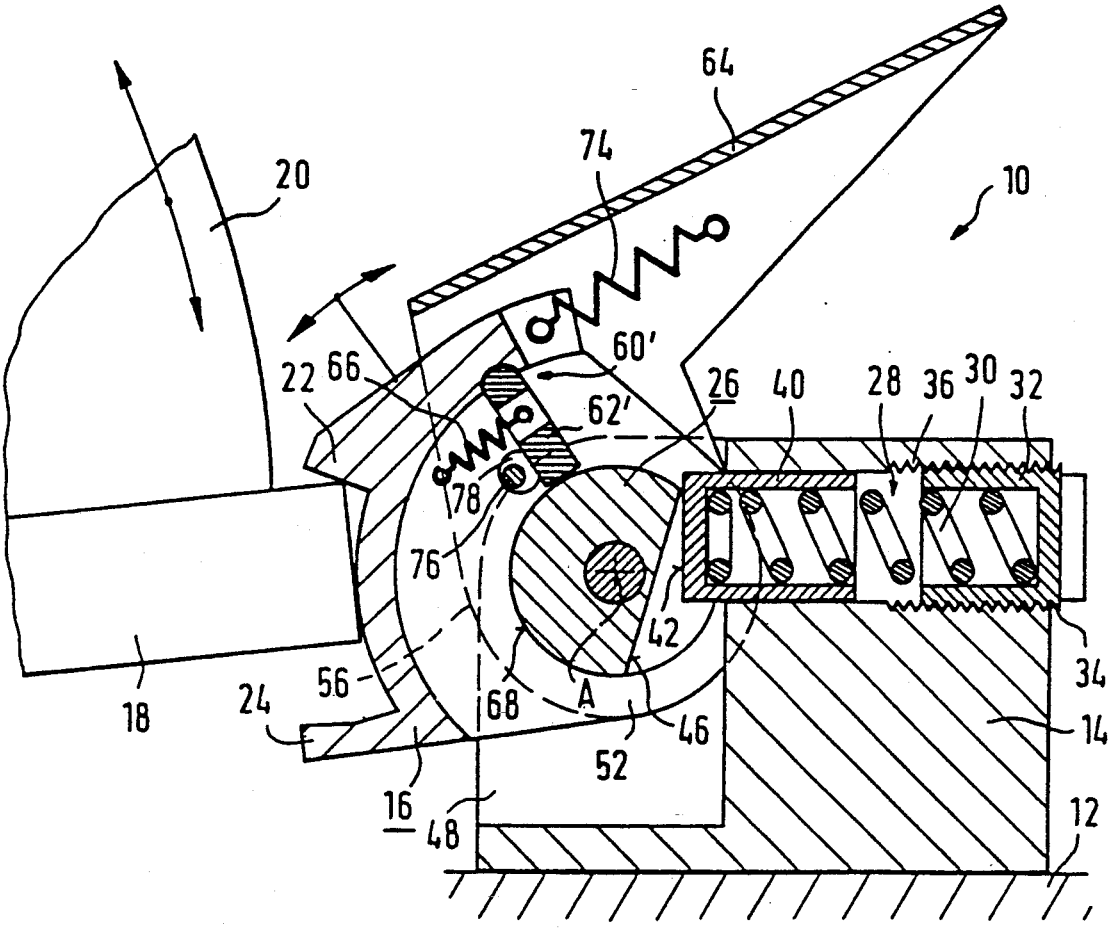
FIG. 2 shows the heel unit shown in FIG. 1 when the sole holder is urged by the ski boot in the opening direction.

FIGS. 1 to 5 show a heel unit 10 of a safety ski binding, which comprises a base body 14 suitable to be fixed to the ski 12 and on which a heel unit 16 is pivotally mounted about a transverse axis A, the sole holder being engaged by the sole 18 of the ski boot 20 (see FIG. 2). For this purpose, the sole holder 16 is provided with a down-holding bracket 22 and a rest lug 24 for the sole.

A return cam 26 is pivotally mounted about the same axis A on the base body 14. The cam is urged into the starting position illustrated in FIGS. 1 and 3 to 5 by a spring arrangement 28 comprising a compression spring 30.

The spring 30 is braced on a first spring abutment 32 at the end remote from the return cam 26, the abutment being a cup-shaped adjustment screw provided with an outer thread 34 which cooperates with an inner thread 36 of a cylindrical bore 38 in the base body 14 (see FIGS. 1 and 2).

The opposed end of the compression spring 30, adjacent to the return cam 26 engages a second spring abutment 40 which also has the shape of a cup and is guided in the cylindrical bore 38 in the manner of a piston.

The return cam 26 has a semicircular portion 44 provided with a flat control surface portion 46, against which the second spring abutment 40 rests in a flat manner via its front face 42 (see FIGS. 1 to 3) when the return cam 26 is not urged by the sole holder 16 (see especially FIGS. 1 and 3 to 5).

Figure 5:
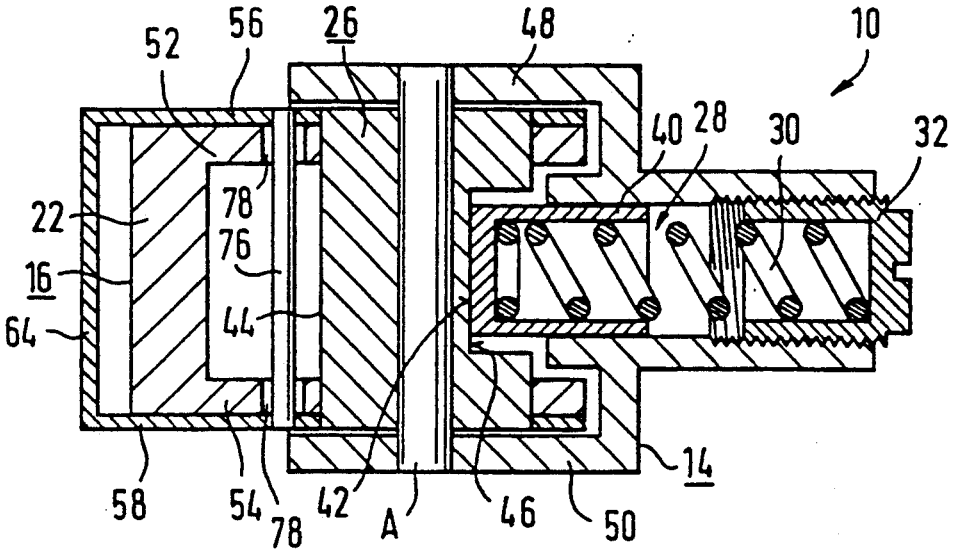
FIG. 5 shows a top view in horizontal cross-section of the heel unit of FIG. 1.

As best seen in FIG. 5, the axis A of the cam and of the sole holder is accommodated in two side walls 48, 50 of the base body 14, spaced from each other. The sole holder 16 pivotally mounted about the same axis A on the base body 14 has a U-shape in longitudinal cross-section, the two arms 52, 54 thereof being located inwardly of the two side walls 48, 50 of the base body 14 which are parallel to these arms. The arms are pivotally mounted on the end regions of the return cam 26. The return cam 26 is cylindrical, with the exception of the semicylindrical portion 44.

In a corresponding manner, a manual actuation lever 64 serving to the manual release of the heel unit 10, which has also a U-shape in longitudinal cross-section, is pivotally mounted via its two arms 56, 58 located between the lateral walls 48, 50 and the arms 52, 54 on the end regions of the cylindrical return cam 26. Accordingly, the manual actuation lever also rotates about the common axis A (see in particular FIG. 5).

A friction-type unidirectional blocking arrangement, realized as a pawl-type blocking arrangement 60' and comprising at least one blocking pawl 62' as blocking member, is mounted between the sole holder 16 and the return cam 26 so as to rotate about the same axis A (FIGS. 1 to 5). This pawl-type blocking arrangement 60' is realized in such a manner that it blocks when the sole holder 16 is urged in the opening direction, and in the present embodiment it can be released by means of the manual actuation lever 64 against a low spring force exerted by a spring member 66.

In the embodiment shown in FIGS. 1 to 5, the blocking pawl 62' is pivotally mounted on the sole holder 16. Spring 66 urges it against a substantially smooth bearing face 68 of the return cam 26. This bearing face 68, which acts as a counter-surface for the blocking pawl 62' which is permanently resiliently urged in the actual blocking position between the return cam 26 and the sole holder 16, has a circular or semicircular shape and is concentric to the axis A of the cam and the sole holder.

The blocking pawl 62' frictionally engages in a force-locked manner this circular or semicircular counter-surface 68 concentric to the axis A of the cam and of the sole holder when the sole holder 16 is biased in the opening direction. It is permanently in sliding contact on this surface 68 when the sole holder 16 is biased in the closing direction, substantially independently of the actual relative rotary position of the sole holder 16 with respect to the return cam 26.

Since the control surface 46 of the return cam 26 urged by the spring arrangement 28 has no culminating point (see for example FIGS. 1 and 2), the return cam 26 is always urged by the spring arrangement 28 independently of the actual rotary position of the cam 26 and only in the closing direction (see for example FIG. 1).

The manual actuation lever 64 serves both to drive the sole holder 16 towards the opening or closing position and to release the friction-type unidirectional blocking arrangement realized as a pawl-type blocking arrangement 60'.

For this purpose, a drive member 76 is provided on the manual actuation lever 64. This drive member 76, in the form of a cylindrical stem and rigidly connected to the lever, is mounted on the two arms 56, 58 of the manual actuation lever and extends through mutually aligned openings 78 of the arms 52, 54 of the sole holder 16 (see for example FIG. 5).

The opening cross-section of the openings 78 provided in the sole holder 16 is larger than the cross-section of the cylindrical drive member 76 which extends through these openings 78.

Since the cylindrical drive stem 76 is fixed on the manual actuation lever 64, the blocking pawl 62' of the friction-type unidirectional blocking arrangement, in the form of a pawl-type blocking arrangement, is additionally released by a corresponding bias. For this purpose, when the manual actuation lever 64 rotates in the opening direction by means of the drive member 76, the blocking pawl 62' covers the two openings 78 as far as, 62' is firstly lifted from the bearing surface 68 of the return cam 26 and the sole holder 16 is thereafter driven in the opening direction with a corresponding delay (see for example FIGS. 3 and 4).

The opening section of the openings 78 must therefore be sized in such a manner that when the lever 64 is actuated in the opening direction by the drive member 76, the blocking pawl 62' can be released first and the sole holder 16 can then be driven following a corresponding delay.

The manual actuation lever 64 and the sole holder 16 are additionally coupled by means of a spring member 74 and urged by the latter towards a starting relative position, in which the pawl-type blocking arrangement 60' is not yet released (see for example FIG. 1).

While in the described embodiment the release of the unidirectional blocking arrangement takes place by means of the manual actuation lever 64, it is possible to include release means by means of which the unidirectional blocking arrangement can be released independently of the manual actuation lever, optionally coupled to the sole holder 16. For this a push-button mechanism, an electronically controlled mechanism, or the like can be provided.

In the present case the heel unit is manually opened by actuation of the lever 64 after the unidirectional blocking arrangement has been released. However, the sole holder 16 can also be gently urged in the opening direction, such that the latter is automatically tilted in its opening position after release of the unidirectional blocking arrangement, eventually driven by the manual actuation lever 64.

Figure 6:
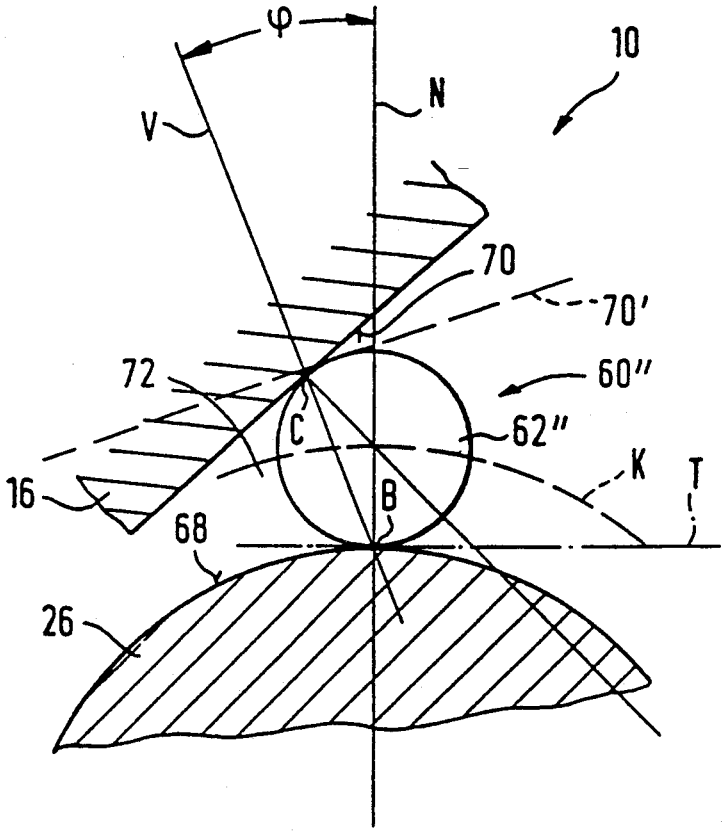
FIG. 6 shows a portion of an other embodiment of the heel unit comprising a roller-type unidirectional blocking arrangement, showing the blocking arrangement.

FIG. 6 shows a portion of a further variant of the heel unit showing the friction-type unidirectional blocking arrangement. It differs from the embodiment of FIGS. 1 to 5 only in that the friction-type unidirectional blocking arrangement is a roller-type unidirectional blocking arrangement 60'' instead of the pawl-type blocking arrangement. It has at least one blocking roller 62''.

In this case too, the circular or semicircular-shaped bearing surface 68 is substantially smooth and provided for example on the return cam 26.

To form an intermediate space 72 which tapers on one side in a wedge-like manner, the counter-surface 70 concentric to the return cam 26 and provided on the sole holder 16 is a plane inclined with respect to the tangent T of the bearing surface 68 passing through the contact point B with the blocking roller 62''. To form the intermediate space 72 which tapers on one side in a wedge-like manner, this counter-surface 70 can also in principle be eccentrically curved.

The blocking roller 62'' is connected to the manual actuation lever 64 (see also FIGS. 1 to 3) which is pivotable about the axis A of the cam and of the sole holder and is coupled to the sole holder 16 via the spring member 74.

Thus, the blocking roller 62'' which is constantly elastically urged into the intermediate space 72, is guided on a circular track K, concentric to the axis A of the cam and the sole holder. The blocking roller 62'' is therefore always in contact with the circular or semicircular-shaped bearing surface 68 concentric to the axis A.

By way of example, the blocking roller 62'' can be made of ceramic material, or it can be covered with ceramic material, or it can be made of steel.

In the case of a blocking roller 62'' made of ceramic material, one roller is generally sufficient. If the rollers are made of steel, provision is made for at least two blocking rollers 62'' opposite from each other or arranged symmetrically. The pressure will then be distributed over a larger number of symmetrically arranged rollers.

Since these rollers exhibit, according to the selected material, different hardnesses and resistances as well as different friction coefficients, the cone angles $\phi$ must also be differently selected.

In FIG. 6, the counter-surface 70 of the sole holder 16 is shown in solid lines for blocking rollers made in ceramic material, and the counter-surface 70' is shown in dashed lines for rollers made of steel.

The cone angle is defined as the angle $\phi$ between the normal N to the bearing and sliding surface 68 at the contact point B with the blocking roller 62'' and the connection line V between the two contact points B, C of the blocking roller 62'' with the bearing and sliding surface 68 and with the counter-surface 70 or 70'. In the case of a blocking roller 62'' of ceramic material, the tangent of this angle $\alpha$ is equal to about 0.3 in the present embodiment, and to about 0.1 in the case of steel rollers.

The heel unit of the invention operates in the following manner:

In the embodiment illustrated in FIGS. 1 to 5, not only the sole holder 16 is driven by the drive member 76 in the opening or closing direction, but the unidirectional blocking arrangement 60 is also released. In the embodiment of FIG. 6, when the lever is actuated in the opening direction, the release of the friction-type unidirectional blocking arrangement 60'' takes place as the blocking roller 62'' connected to this lever is moved in the other direction out of the intermediate space 72 which tapers in a wedge-like manner. For the rest, the two variants operate in a similar manner.

In the view of FIG. 1, neither the sole holder 16 nor the manual actuation lever 64 are biased. Therefore, the sole holder 16 occupies its closing position, whereas the return cam 26 urged by the spring arrangement 28 is held in its starting rotary position corresponding to the closing position.

The sole holder 16, as well as the manual actuation lever 64, are held by the spring 74 in their starting relative rotary position in which the driving member 76 contacts the edge of the opening 78 remote from the blocking member 62' and is thus disengaged from the blocking member 62'.

In FIG. 2, the sole holder 16 is urged by the ski boot 20 in the opening direction and tilted upwardly away from the final position. The manual actuation lever 64 is then driven by the sole holder 16. Owing to the spring 74, the driving member 76 remains in contact with the edge of the openings 78 of the sole holder 16 remote from the blocking member 62'. As a result, the friction-type unidirectional blocking arrangement 60' is blocked, whereby the return cam 26 is also rotated in the opening direction about the common axis A together with the sole holder 16 against the relatively high spring force exerted by the compression spring 30 of the spring arrangement 28.

Since the opening force exerted by the ski boot 20 on the sole holder 16 decreases, the sole holder 16 is again urged downwardly into the final closing position by the compression spring 30, with the return cam 26 and the friction-type unidirectional blocking arrangement 60' still being in a blocking condition.

If the force exerted by the ski boot 20 on the sole holder 16 in the opening direction overcomes the return force, the boot is released upwardly out of the sole holder 16. Immediately after such a release, the sole holder is pivoted back to the closing position due to the return force (see FIG. 1).

Figure 3:
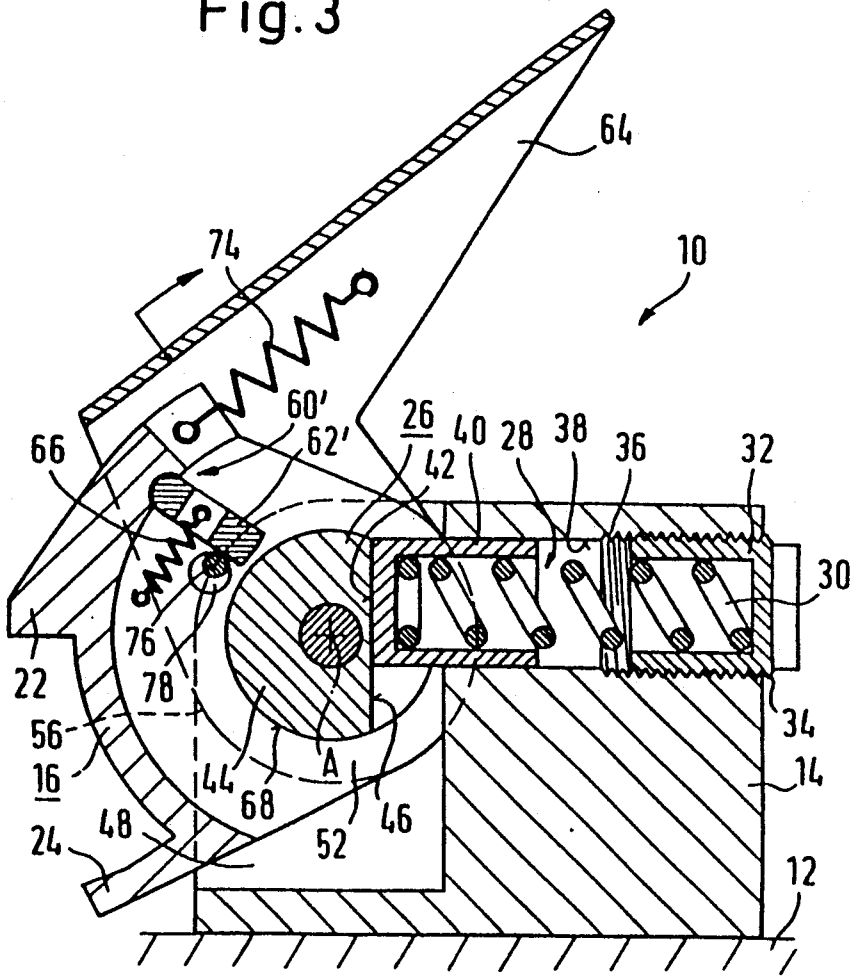
FIG. 3 shows the heel unit shown in FIG. 1, just before a voluntary release by means of the manual actuation lever, the sole holder still occupying its closing position.

In FIG. 3, the heel unit is shown in a position immediately before a voluntary release by means of the manual actuation lever 64. This manual actuation lever 64 is then already tilted or pushed downwardly in the direction of the arrow, as far as the blocking pawl 62' is lifted from the bearing surface 68 by means of the driving member 76, and the friction-type unidirectional blocking arrangement 60 realized as a pawl-type blocking arrangement is thus released.

As soon as the manual actuation lever 64 is further pushed downwardly, the sole holder 16 is driven in the opening direction, by the same driving member 76. The return cam 26 remains then in its starting rotary position because the friction-type unidirectional blocking arrangement 62' is released, such that one can open the heel unit with a minimum effort while avoiding the return force exerted by the spring arrangement 28.

Figure 4:
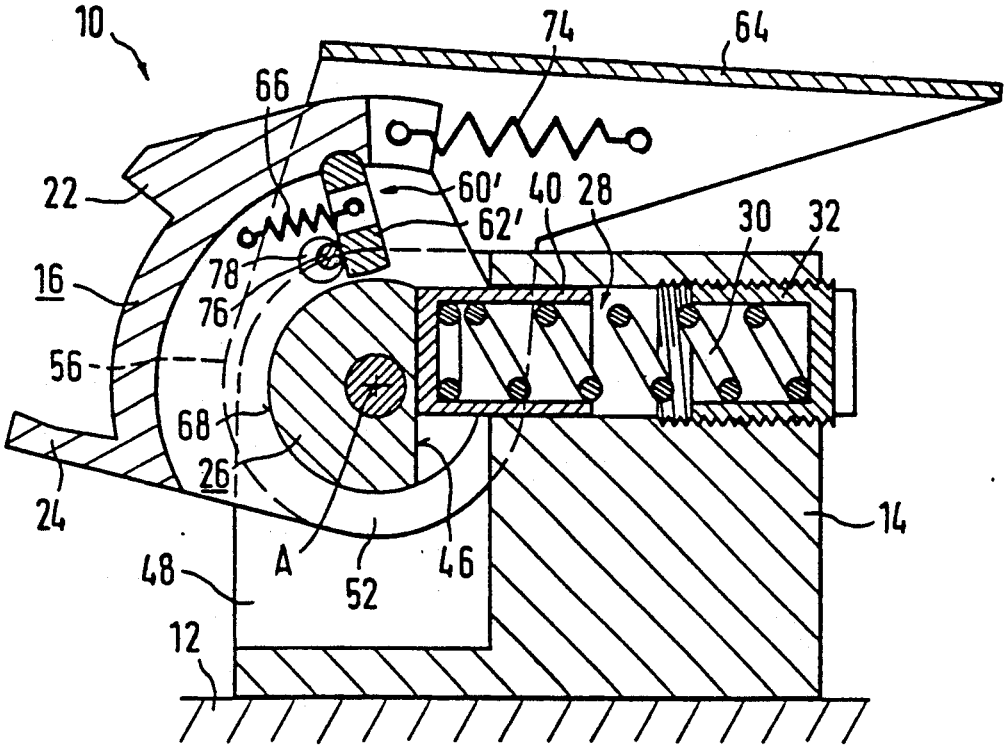
FIG. 4 shows the heel unit of FIG. 1 after manual release, the sole holder being rotated into the opening position.

In FIG. 4, the manual actuation lever 64 is fully displaced downwardly in its opening position in which it extends generally parallel to the ski 12. When the return cam 26 thereafter takes its starting rotary position, the sole holder 16 driven by the lever has reached its opening position.

The heel unit is thereafter closed by pivoting the sole holder 16 again downwardly in the closing direction, for example by means of the ski boot and/or the lever. During this rotary movement, the blocking member 62' of the friction-type unidirectional blocking arrangement 60' which operates in the manner of a free-running drive slides along the circular or semicircular-shaped bearing surface concentric to the axis A. During this closing movement of the sole holder, the manual actuation lever 64 also coupled to the sole holder via the spring 74 is driven, provided this lever is simultaneously actuated.

As soon as the sole holder is again urged in the opening direction, the friction-type unidirectional blocking arrangement 60', is automatically blocked to again establish a rigid coupling between the sole holder 16 and the return cam 26 urged by the spring. The behaviors described in connection with FIG. 2 again take place.

It is important that owing to the permanent contact if the blocking member 62' against the circular or semicircular-shaped counter-surface 68 concentric to the axis A, or the positioning of these two components at as small a distance as possible, the friction-type unidirectional blocking arrangement is able to block at any time, i.e. independently of the actual relative rotary position of the sole holder 16, as soon as the sole holder is correspondingly urged in the opening direction. Thus, blocking is possible even if the sole holder 16 cannot be fully pivoted downwardly into its final closing position, for example because ice or snow is trapped between the shoe sole and the surface of the ski.

Independently of the actual starting rotary position of the sole holder, on occurrence of any bias in the opening direction, the return cam 26 is also always tilted against the spring force of the compression spring 30 from the final position shown for example in FIG. 1, such that the entire stroke of the spring is always available for a safety release.

As a variant of the described embodiments, release means for releasing the friction-type unidirectional blocking arrangement, which can be actuated independently of a manual actuation lever, or the like, can optionally be provided and coupled to the sole holder. For this purpose, a push-button mechanism, an electronically controlled mechanism and/or the like can be used. Features can be included for automatically tilting the sole holder in the opening direction after a release of the unidirectional blocking arrangement, for example in the form of a spring arranged between the base body and the sole holder.

FIG. 7 to 12 show a further embodiment of a heel unit 10 comprising a friction-type unidirectional blocking arrangement realized as a roller-type unidirectional blocking arrangement 60" which also comprises a base body 14 intended to be secured to the ski. A sole holder 16 is pivotally mounted on the base body about an axis A and engages the sole of a ski boot with a down-holding jaw 22 and a bearing lug 24.

Figure 7:
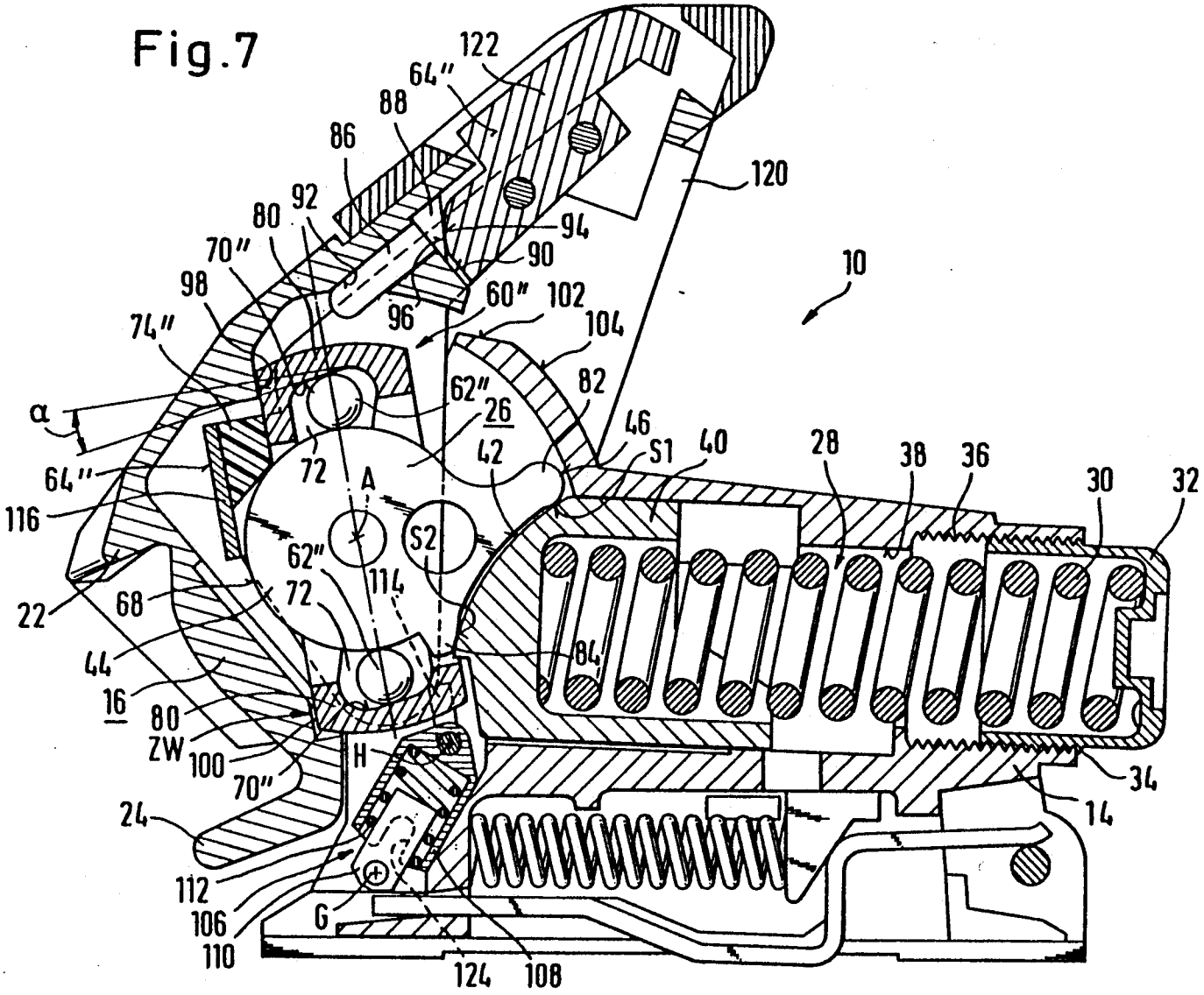
FIG. 7 is a schematic cross-sectional view of a further variant of a safety heel unit equipped with a roller-type unidirectional blocking arrangement, in the closing position.
Figure 9:
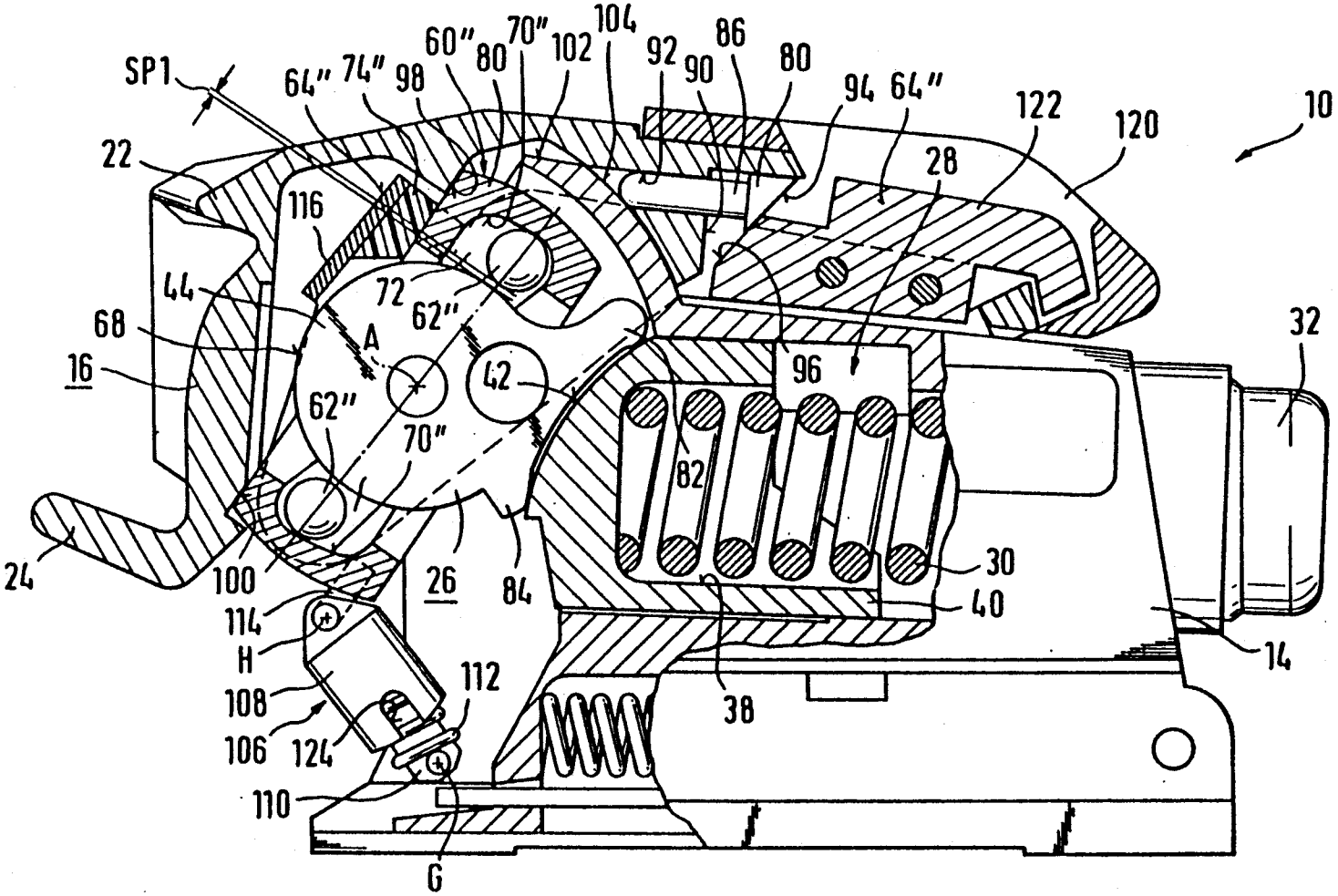
FIG. 9 shows the heel unit of FIG. 7, after release, with the sole holder pivoted into the opening position.
Figure 10:
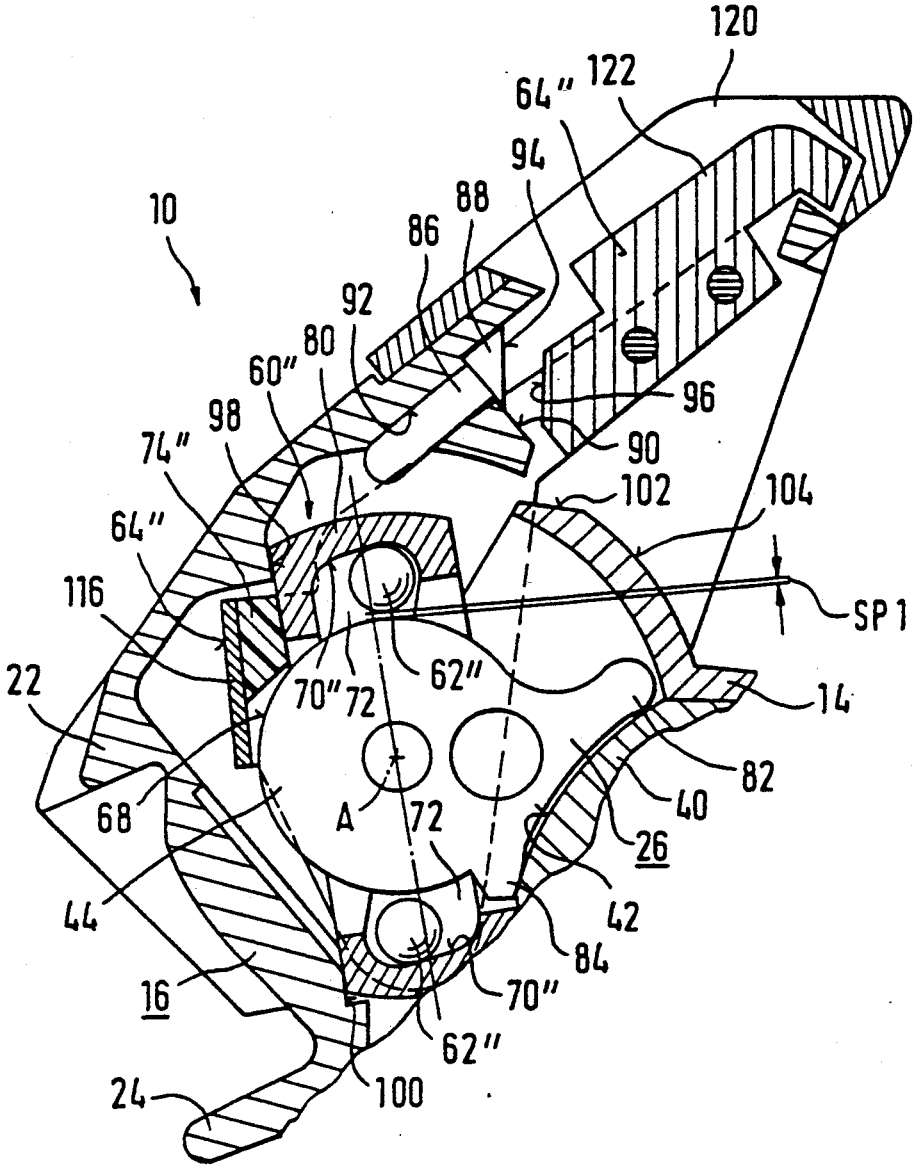
FIG. 10 shows the heel unit of FIG. 7, just before voluntary manual release by means of the release lever, in which the sole holder still occupies its closing position.

A return cam 26 pivotally mounted on the base body 14 about the same axis A is urged by a spring arrangement 28 into the starting position shown in FIGS. 7, 9 and 10. The spring arrangement 28 comprises a compression spring 30, which is supported on a first spring abutment 32 at the end remote from the return cam 26. The spring abutment is realized as a cup-shaped adjustment screw provided with an outer thread 34 which cooperates with an inner thread 36 of a cylindrical bore 38 in the base body 14 (see especially FIG. 7). At the other end adjacent to the return cam 26, the compression spring 30 is supported against a second spring abutment 40, also having the shape of a cup, which is guided in the cylindrical bore 38 in the manner of a piston.

The return cam 26 comprises a partly cylindrical portion 44, concentric to the axis A of the cam and of the sole holder, on which are defined two projections 82, 84 spaced from each other. The second spring abutment engages these projections when the return cam 26 is not loaded by the sole holder 16 (see in particular FIGS. 7, 9 and 10). The spring abutment is engaged via its end face 42 which is corresponding curved. Thus, the second spring abutment 40 contacts at two places S1 and S2 the return cam 26 which occupies its starting position. As soon as the return cam 26 is rotated out of its starting position by the sole holder 16 and the roller-type unidirectional blocking arrangement 60"against the spring force exerted by the compression spring 30, the return cam 26 contacts the end face 42 of the second spring abutment 40 only with the curved control surface portion 46 on the upper projection 82 (see FIG. 8).

The roller-type unidirectional blocking arrangement 60" between the sole holder 16 and the return cam 26 comprises a roller cage 80 rotatably mounted about the axis A of the cam and of the sole holder, and two blocking rollers 62" arranged diametrically opposite to each other, which are each received in an intermediate space 72 located between the bearing and sliding surface 68 of the return cam 26 and a counter-surface 70" of the roller cage 80. The substantially smooth bearing surface 68 provided at the exterior on the return cam 26 has a circular or semicircular outline concentric to the axis of the cam and of the sole holder. The counter-surfaces 70" provided at the interior inside the roller cage 80 are each formed so that the respective intermediate space 72 tapers in a wedge-like manner in one of the rotation directions (in the present case in the counter-clockwise direction). The counter-surface 70" are preferably oriented in such a manner that an angle $\alpha$ of about 10° C. is formed between the normal N of the bearing surface 68 at the contact point B with the blocking roller 62" and the normal N' of the counter-surface 70" at the contact point C with the blocking roller 62" (see FIGS. 11 and 7).

The roller cage 80, which in the present embodiment is distinct from the sole holder 16, is brought into its rotary position with respect to the sole holder 16 by means of two abutment faces 91, 100 spaced from each other and provided on the sole holder 16. Due to the engagement of the roller cage 80 by the counter-surface 98 or 100, a fixed coupling is established between the roller cage 80 and the sole holder 16 for joint rotation. Appropriately, a slight play can be left here between the roller cage 80 and the sole holder 16, as is indicated in FIG. 7 by a small intermediate space ZW, between the lower abutment face 100 and the roller cage 80 when the roller cage 80 simultaneously directly contacts the upper abutment face 98.

Figure 11:
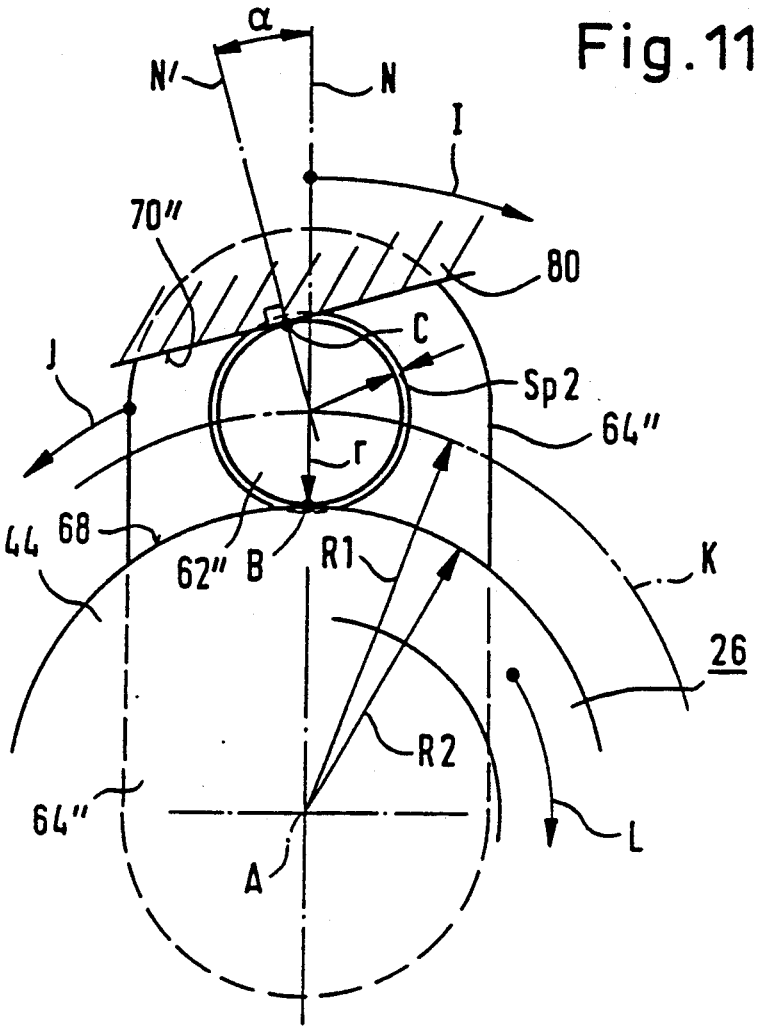
FIG. 11 shows a portion of the roller-type unidirectional blocking arrangement of the heel unit of FIG. 7.

As is best seen in FIG. 11, the blocking rollers 62" which are resiliently urged in the blocking position are guided on a circular track K having a radius R1, concentric to the axis A of the cam and the sole holder. The radius of the circular track is at least substantially larger, by the radius r of the two cylindrical blocking rollers 62", than the radius R2 of the bearing surface 68 on the exterior of the partly cylindrical portion 44 of the return cam 26.

The blocking rollers 62" are mounted on a release lever 64" which is pivotally mounted on the base body 14 about the axis A of the cam and the sole holder. This release lever 64" is urged by means of a spring member 74" in a starting rotary with respect to the roller cage 80, position in which the blocking rollers 62" occupy their blocking position shown in FIGS. 7, 8 and 11.

The spring member 74", which is for example a spring made of polyurethane, a compression spring or a metal leaf spring, is arranged between a spring abutment 116 on the release lever 64'' and the roller cage 80.

The release lever 64 is bent and mounted at the interior of the sole holder 16 which is extended by a lever arm 120. This release lever is accessible from the outside for a manual actuation at the upper or rear head 122. The release lever 64 can be pivoted rearwardly against the relatively low spring force 74'' and into the interior of the sole holder 16 relative to the roller cage 80 as far as the blocking rollers 62'' are brought into the release position shown in FIGS. 9 and 10, where the blocking rollers 62'' are located in the respective intermediate spaces 72 with a certain play Sp1.

It is possible to add to the unidirectional blocking arrangement 60, realized in the present embodiment as a roller-type unidirectional blocking arrangement 60'', a release device actuated independence on the rotary position of the sole holder 16. The release device comprises a release piston 86, guided in a bore 92 of the sole holder 16, and cooperating with a climbing ramp 102 provided on the base body 14 and with a surface portion 104 of the base body 14 which follows the climbing ramp. The release piston urges the release lever in the opening direction and has a partly cylindrical shape concentric to the axis A of the cam and of the sole holder.

On the climbing ramp 102 and at the remote end of the cylindrical surface portion 104, the release piston 86 includes an abutment 88 which is held against an abutment surface 80 of the sole holder 26 when the release lever 64'' is not actuated. On its side remote from the abutment surface 90, the abutment 88 has an inclined surface 94 which is engaged by the rear end 122 of the release lever 64'' via a slightly curved counter-surface 96, the release lever being urged by a spring.

The release piston 86 and the climbing ramp 102 as well as the partly cylindrical surface portion 104 are arranged with respect to each other and designed in such a manner that the unidirectional blocking arrangement, realized for example as a roller-type unidirectional blocking arrangement 60'', is also always compulsorily released when the sole holder 16 reaches a rotary position within a rotary range defined at least substantially by a release position of the ski boot (see FIG. 8) and the opening position (see FIG. 9).

Between the base body 14 and the roller cage 80, which is solidly coupled to the sole holder 16, is a tilting mechanism 106. It comprises a cylindrical spring housing 108 pivotally mounted about an axis H on a connection arm 114 of the roller cage 80, a stem-shaped spring abutment 110 pivotally mounted about an axis G on the base body 14 at one end and guided in the spring housing 108, and a compression spring 112 arranged between the spring housing 108 and the spring abutment 110. The two pivot axes G, H extend parallel to the axis A of the cam and of the sole holder and parallel to the blocking rollers 62''. At one end, the compression spring 112 rests against the bottom of the spring housing 108 which is open on one side for receiving the stem-shaped spring abutment 110. At the other end, the compression spring 112 can rest for example against the pivot axis G (see FIG. 9) or against a piston 118 guided in the cylindrical spring housing 108 and provided on the spring abutment 110 (see FIG. 12).

In the first case, the spring housing 108 can be provided with lateral slots 124 such that it can be displaced against the force of the spring partly up to beyond the pivot axis G. In this case, the stem-shaped spring abutment 110 is at least partly surrounded by the compression spring 112.

Figure 12:
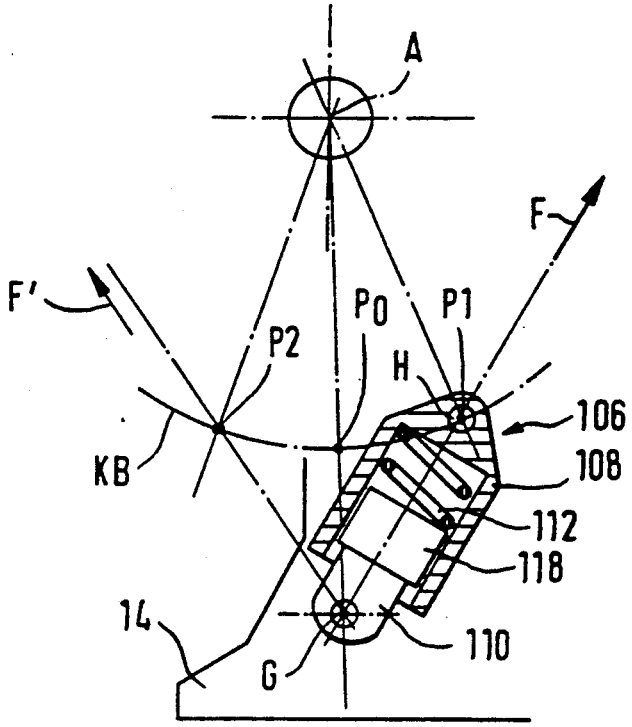
FIG. 12 shows a schematic representation of the additional tilting mechanism included in the heel unit of FIG. 7.

In the closing position of the sole holder 16, the tilting mechanism 106 occupies the tilting position designated P1 in FIG. 12, in which the roller cage 80 and consequently the sole holder 16 are urged by a slight spring force F into the closing position. If the sole holder 16 is rotated away from the closing position, the spring 112 is progressively compressed until it reaches an intermediate rotary position P0. After having reached this intermediate rotary position PO, the tilting mechanism 106 acts in the opening direction, until it has reached the rotary position P2 corresponding to the opening position of the sole holder 16, in which the roller cage 80, and via the latter the sole holder 16, is urged in the opening direction by a slight spring force F'. In this case, the pivot axis H is guided along a circular path KB concentric to the axis A of the cam and the sole holder.

Consequently, the sole holder 16 is urged in the opening direction by the tilting mechanism 106, as long as it occupies a rotary position between a opening position and a predetermined intermediate position, and it is urged in the closing direction by the same tilting mechanism as long as it occupies a rotary position between its closing position and the predetermined intermediate position.

The variant shown in FIGS. 7 to 12 of the heel unit of the invention operates in the following manner:

In the view of FIG. 7, neither the sole holder 16 nor the release lever 64'' are urged. Therefore, the sole holder 16 occupies its closing position in which it is additionally urged by the tilting mechanism 106.

The blocking rollers 62'' are held in their blocking position by the release lever 64'' which is resiliently loaded, such that the roller-type unidirectional blocking arrangement 62'' ensures a solid coupling between the sole holder 16 and the spring-loaded return cam 26 as soon as the sole holder 16 is urged in the opening direction by the ski boot.

Figure 8:
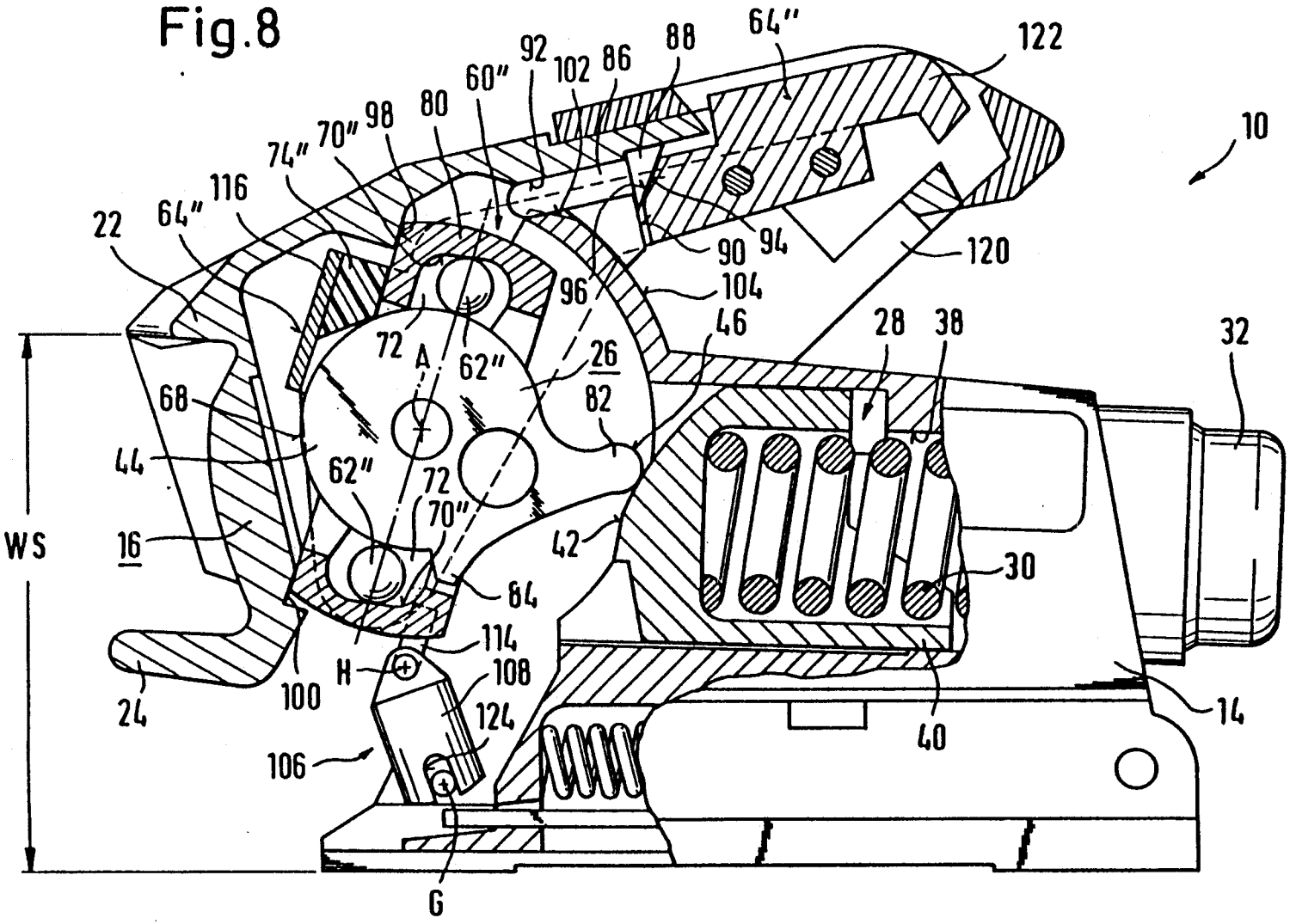
FIG. 8 shows the heel unit of FIG. 7, in which the sole holder is urged by the ski boot in the opening direction.

In accordance with FIG. 8, the sole holder 16 is urged in the opening direction by the ski boot (shown only in FIG. 2) and rotates upwardly away from the closing position. Until reaching the rotary position WF illustrated in FIG. 8, in which the release piston 86 comes in engagement on the climbing ramp 102, the roller-type unidirectional blocking arrangement 60'' remains blocked. Thus, the return cam 26 is also rotated together with the sole holder 16 in the opening direction about the common axis and against the relatively high spring force exerted by the compression spring 30 of the spring arrangement 28.

As indicated in FIG. 11, the roller cage 80 is thus driven by the sole holder in the direction of the arrow I, while the blocking rollers 62'', which are mounted with a certain play Sp2 in the release lever 64'', are pushed in the opposite direction J by the resiliently-loaded release lever 64'', such that these rollers take their blocking position. As a result, the spring-loaded return cam 26 is displaced in the direction of the arrow L.

If the force exerted by the ski boot on the sole holder 16 in the opening direction overcomes the return force, the boot is released upwardly out of the sole holder 16. In the corresponding rotary position of the sole holder 16 beyond the rotation region WS under resilient load, the release piston 86 is already engaged against the partly cylindrical surface portion 104 of the base body 14, whereby the release lever 64'' is forcibly rotated with respect to the roller cage 80 as far as the blocking rollers 62'' take their release position. The return cam 26 is consequently returned to its starting rotary position without driving the sole holder 16. In contrast, the latter is brought by the tilting mechanism 106 into the opening position shown in FIG. 9.

In FIG. 10, the heel unit is shown in a position immediately before a voluntary manual release. While the sole holder 16 still occupies its closing position, the release lever 64'' is manually pivoted against the spring force 74'', for example by means of a ski pole, as far as the blocking rollers 62'' take their release position inside the intermediate spaces 72, and the roller-type unidirectional blocking arrangement 60'' is consequently released.

If the release lever 64'' is further actuated, the sole holder 16 can be pivoted in the opening direction, for example by means of its lever arm 120, without the spring-loaded return cam 26 being then driven. The latter remains in its starting position shown in FIG. 10.

To close the heel unit, the sole holder 16 is rotated downwardly in the closing direction, for example by means of the ski boot and/or by means of its lever arm 120. During this rotary movement the blocking rollers 62'' of the unidirectional blocking arrangement 60'', which operates as a free-running drive mechanism, are guided freely along the circular or semicircular bearing surface 68 concentric to the axis A. After the tilting mechanism 106 has reached the intermediate rotary position P0 (see FIG. 11) the closing movement is furthermore assisted by tilting mechanism 106, by means of which the sole holder 16 is then urged in the closing direction via the roller cage 80. Thus , there occurs an automatic post-adjustment of the heel unit, for example, in those cases in which a layer of ice and/or snow present between the shoe sole and the surface of the ski progressively disappears, especially under the forces generated by shocks and vibrations and under the pressure exerted by the shoe. Simultaneously, an automatic adaption to different sole thicknesses is reached.

As soon as the sole holder 16 is again urged in the opening direction, the roller-type unidirectional blocking arrangement is automatically blocked, which establishes again a solid coupling of the sole holder with the return cam 26.

Figure 13:
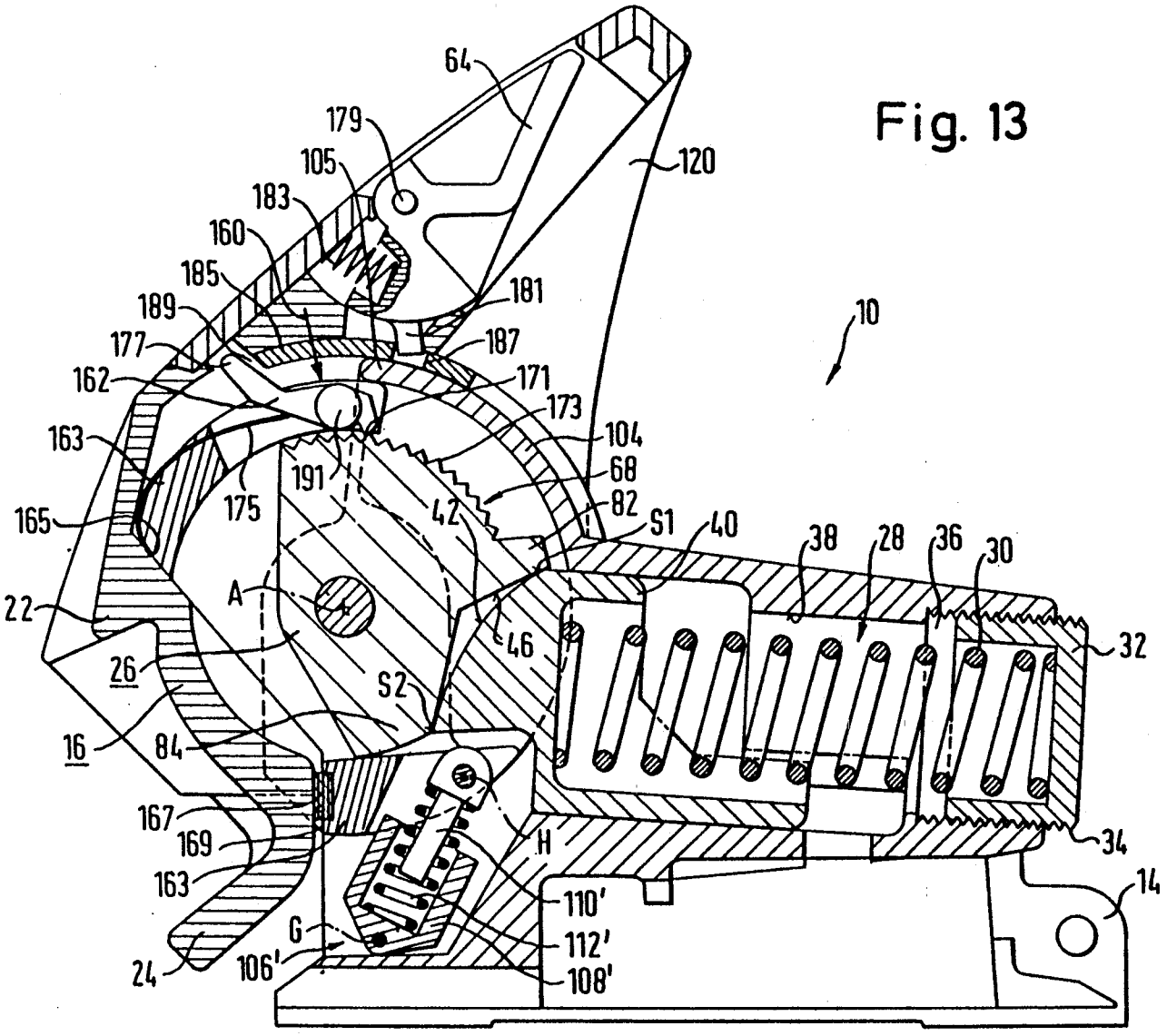
FIG. 13 shows a schematic cross-sectional view similar to that of FIG. 7 of a further variant of a safety heel unit equipped with a pawl-type unidirectional blocking arrangement, in the closing position.

The embodiment shown in FIG. 13 comprises a unidirectional blocking arrangement, designated by the reference 160, including a toothed pawl. Besides, this embodiment includes a certain number of components which have already been described in connection with the embodiment of FIGS. 7 to 12, which will not be described again in detail. In FIG. 13, they bear the same reference numerals.

Here, the pawl 162 is rotatably mounted on an intermediate cage 163 which is in turn rotatably mounted about the common axis A of the return cam 26 and of the sole holder 16. The cage 163 abuts against the sole holder 16 both directly via a first bearing surface 165 and indirectly via a second bearing surface 169 through a resilient member 167. The purpose of the resilient member 167 is merely to compensate for manufacturing tolerances of the sole holder 16 and of the cage 163, such that the latter is practically fixedly connected to the sole holder 16. It is even possible to omit such an intermediate cage and to mount the rotary pawl 162 directly on the sole holder 16.

On one side of its rotation axis, the pawl 162 ends in a tooth 171 radially directed toward the axis A, and the bearing surface 68 of the return cam 26 comprises a toothed sector 173. A spring 175 engages the intermediate cage 163 and biases the pawl 162 in such a manner that its tooth 171 engages this toothed sector.

On its side opposite from the rotation axis, the pawl comprises a release arm 177 inclined with respect to a radial direction from the common axis A of the return cam 26 and the sole holder 16.

In the position shown in FIG. 13, the engagement of the tooth 171 of the pawl 162 in the toothed sector 173 of the return cam 26 causes a force-locked cooperation between the sole holder 16 and the return cam 26 in the opening direction of the heel unit 10, and contrarily a practically effortless rotation of the sole holder 16 with respect to the return cam 26 in the closing direction of the heel unit 10, practically in the same manner as in the previous embodiments, the only difference being that the blocking occurs here only for a determined number of relative positions for which the tooth 171 of the pawl 162 engages between the teeth of the toothed sector 173 of the return cam. Nevertheless, the pitch of the teeth of the toothed sector can be selected sufficiently small to obtain a blocking action practically independently of the relative rotary position of the sole holder and the return cam.

In this embodiment, the manual actuation lever 64 is rotatably mounted about an axis 179 which extends through the extension arm 120 of the sole holder 16, and ends in a finger 181 generally directed toward the axis A and located at a distance from the latter which is at most equal to the radial distance between the axis A and the release arm of the pawl 162. A spring 183 arranged between the sole holder 16 and the actuation lever 64 urges the latter towards a rest position, shown in FIG. 13, in which the distance between the finger 181 of the lever 64 and the release arm 177 of the pawl 162 is at a maximum. A thrust member 185, in the form of a semicylindric flap rotatably mounted about the axis A via mounting means which are not shown in the drawing, is located at a radial distance from the axis A which corresponds to that of the finger 181 and of the arm 177 of the pawl. The finger 181 of the actuation lever engages a recess 187 of the flap such that a tilting of the actuation lever 164 causes a rotation of the thrust member 185 toward the release arm 177 of the pawl 162 and, when the edge 189 of the thrust member 185 reaches the release arm 177, it compels the latter to rotate, with the result that the tooth 171 at the other end of the pawl 162 is moved out of engagement with the toothed sector 173 of the return cam. The sole holder 16 is then free to rotate in the opening direction as in the previous embodiments.

To obtain an automatic release of the pawl-type blocking arrangement 160 beyond a certain rotation angle in the opening direction, in a manner similar to the embodiment of FIGS. 7 to 10, the base body 14 comprises a semicylindric upper extension 104, located at a radial distance from the axis A substantially corresponding to the radial distance of the release arm 177 of the pawl 162 and slightly less than the radial distance of the thrust member 185. This extension ends in an abutment edge 105 located at a predetermined angle from the release arm 177, so that the latter comes into contact against this abutment edge 105 when the rotation of the sole holder 16 overcomes the predetermined angle, and the tooth 171 of the pawl 162 comes out of engagement with the toothed sector 173 of the return cam 26 because of the resulting rotation of the pawl 162.

The recess 187 of the flap 185 is preferably a blind recess and the flap forms a closure member for the space between the base body 14, more precisely its abutment edge 105, and the sole holder 16 to prevent the ingress of mud, snow or ice toward the interior of the device.

In addition, in this embodiment the tilting mechanism 106' is mounted in an inverted manner, i.e. its spring housing 108' is rotatably mounted on the base body 14, while its spring abutment 110' is rotatably mounted on the cage 163, or on the sole holder 16. This has the advantage to prevent the ingress of mud, snow or ice, which are practically always present in this lower area of the heel unit, towards the interior of the tilting mechanism 106'.

Figure 14:
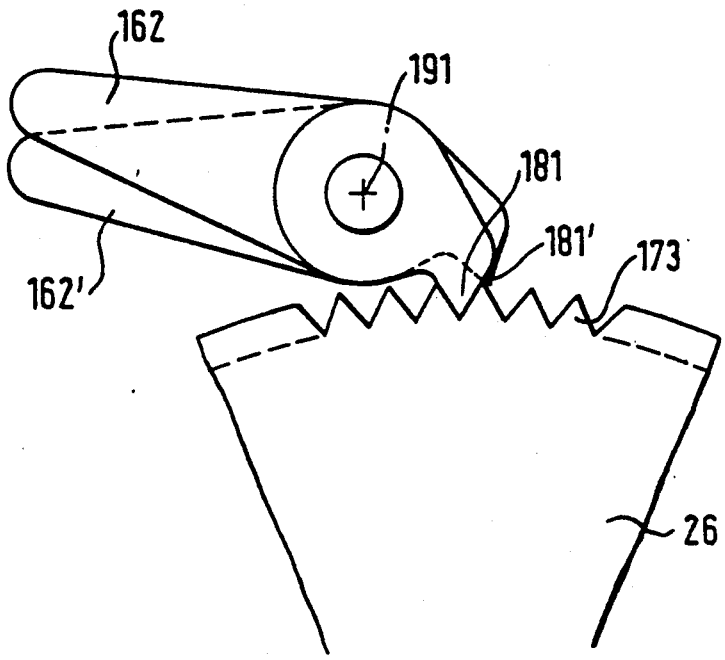
FIG. 14 shows a detail of a variant of the embodiment of FIG. 13.

Finally, in order to reduce the play between the pawl 162 and the toothed sector 173 of the return cam 26 when the tooth 171 of the pawl is not exactly engaged between two successive teeth of the toothed sector, the pawl 162 advantageously has two parts 162 and 162' mounted side-by-side on the same axis 191, as indicated in FIG. 14, and their teeth 171, 171' are offset in the peripheral direction of the return cam 26 by a distance which corresponds to half of the pitch of the teeth of the toothed sector 173 of the return cam. It is even possible to generalize to any number N of pawls, the teeth of which will then be successively offset in the peripheral direction of the return cam by a distance corresponding to 1/Nth of the pitch of the teeth of the toothed sector.

What is claimed is:

1. Heel unit (10) of a safety ski binding, comprising a base body (14) intended to be fixed to a ski (12), a return cam (26) rotatably mounted on the base body (14) about an axis (A) and returned by a first spring device (28) into a rotary starting position, a sole holder (16) rotatably mounted about the axis (A), a unidirectional blocking arrangement (60) arranged between the return cam (26) and the sole holder (16) comprising at least one blocking arrangement (60), said blocking arrangement including at least one blocking member for blocking said sole holder in an opening direction of the sole holder and said blocking member being releasable against the slight spring force of a second spring device (66) by means of a manual release lever (64), one of the return cam (26) and the sole holder (16) being provided with a bearing face (68), having a generally circular shape and being concentric to the axis (A) of the return cam and of the sole holder, for the blocking member (62) which is permanently resiliently urged into a blocking position between the return cam (26) and the sole holder (16), said blocking member (62) being supported in a force-locked manner on the bearing face (68) when the sole holder is urged in the opening direction, and permanently engaging the bearing face (68) without force transfer when the sole holder is urged in a closing direction, substantially independently of the actual rotary position of the sole holder (16) relative to the return cam (26), to permit a relative displacement of the sole holder (16) with respect to the return cam (26) in the closing direction and substantially without effort.

2. Heel unit according to claim 1, wherein the unidirectional blocking unit (60) is realized as a frictionally-blocking arrangement (60').

3. Heel unit according to claim 2, wherein the frictionally-blocking unidirectional blocking arrangement (60'), comprises at least one blocking pawl as blocking member (62'), the blocking pawl (62') being pivotally mounted on the sole holder (16), the bearing face (68) being a substantially smooth semicylindrical surface provided on the return cam (26), and the blocking pawl (62') being held in contact against said bearing face (68) by means of a spring member (66) arranged between the blocking pawl (62') and the sole holder (16).

4. Heel unit according to claim 2, wherein the frictionally-blocking unidirectional blocking arrangement is realized as a roller-type unidirectional blocking arrangement (62) comprising at least one blocking roller (62''), wherein the bearing face (68) is a substantially smooth semicylindrical bearing face provided on the return cam (26), and including a counter-surface (70) on the sole holder (16) formed eccentrically or planar and inclined with respect to a tangent (T) to the bearing face (68) extending through a contact point (B) with the blocking roller (62'') to define an intermediate space (72) which tapers on one side in a wedge-like manner.

5. Heel unit according to claim 4, including means for guiding the blocking roller (62'') in contact with the concentric bearing face (68) on a circular path (K) concentric to the axis (A) of the return cam (26) and of the sole holder (16).

6. Heel unit according to claim 4, wherein the blocking roller (62'') comprises a ceramic material, wherein a tangent of an angle ($\phi$), between the Normal (N) to the bearing face (68) extending through a contact point with the blocking roller (62'') and a connection line (D) of two contact points (B, C) of the blocking roller (62'') with the bearing face (68) and with the counter-surface (70), is equal to about 0.3.

7. Heel unit according to claim 4, including at least two steel rollers (62'') mounted symmetrically with respect to each other, wherein a tangent of an angle ($\phi$) between a normal (N) to the bearing face (68) extending through the contact point with the blocking roller (62'') and a connection line (D) of two contact points (B, C) of the blocking roller (62'') with the bearing face (68) and with the counter-surface (70), is equal to about 0.1.

8. Heel unit according to claim 4, wherein the unidirectional blocking arrangement (62) comprises at least one blocking roller (62''), includes a roller cage (80) rotatably mounted about the axis (A) of the cam and of the sole holder; wherein the cage (80) is fixedly coupled to the sole holder for rotation therewith; wherein an intermediate space (70'') which tapers on one side in the manner of a wedge is formed between the bearing face (68) and a counter surface (70'') provided on the roller cage (80) and receives a respective blocking roller (62''); and wherein the blocking roller (62'') which is guided on a circular track (K) concentric to the axis (A) of the cam and of the sole holder, is resiliently urged (74'') into the blocking position.

9. Heel unit according to claim 8, including at least two diametrically opposite blocking rollers (62''); and wherein the blocking rollers (62'') are respectively accommodated in a respective intermediate space (72) located between the bearing face (68) of the return cam (26) and a counter-surface (70'') of the roller cage (80).

10. Heel unit according to claim 8, including a release lever (64'') pivotally mounted on the base body (14) about the axis (A) of the cam and of the sole holder, the blocking roller being mounted on the release lever, whereby the roller-type unidirectional blocking arrangement (60'') can be released by a corresponding displacement of the blocking roller (62'') with respect to the roller cage (80).

11. Heel unit according to claim 10, including means for resiliently holding the release lever (64'') in a starting rotary position with respect to the roller cage (80), in which the blocking roller (62") occupies its blocking position.

12. Heel unit according to claim 10, wherein the sole holder (16) is extended by a lever arm (120), the release lever (64") being arranged inside the sole holder (16) and being accessible from the exterior.

13. Heel unit according to claim 1, wherein the unidirectional blocking arrangement (60) includes a pawl-type unidirectional blocking arrangement (160) comprising at least one pawl (162) pivotally mounted on the sole holder (16) and ending on one side in a tooth (181) oriented towards the return cam (26); the bearing face (68) of the latter comprising a corresponding toothed sector (173); and means resiliently urging the pawl (162) in such a manner that the tooth (181) comes into engagement with said toothed sector (173).

14. Heel unit according to claim 13, wherein the pawl blocking arrangement comprises at least two pawls (162, 162"); and wherein the teeth (181, 181') of said pawls are successively offset in a peripheral direction of the return cam (26) by a distance which substantially corresponds to a pitch of the teeth of the toothed sector (173) of said return cam (26), divided by the number (N) of pawls (162, 162').

15. Heel unit according to claim 13, including a release arm inclined with respect to a radial direction from the common axis (A) of the return cam (26) and the sole holder (16) and extending each pawl (162) on the side remote from the tooth (181) and wherein the base body (14) comprises an abutement (105) located at a predetermined angle with respect to said release arm (177) when the sole holder (16) occupies a closing position such that, when the rotation of the sole holder (16) exceeds said predetermined angle, said release arm (177) engages said abutement (105) and the tooth (181) of the pawl (162) comes out of engagement with the toothed sector (173) of the return cam (26) following the pivoting of the pawl (162) resulting therefrom.

16. Heel unit according to claim 15, further comprising a manual actuation lever pivotally mounted on the sole holder (16) and resiliently returned to a rest position, and a thrust member (85) pivotally mounted on the base body about the common axis (A) of the sole holder (16) and of the return cam (26), said thrust member (185) being driven by said actuation lever (64) and having an edge (189) directed towards the release arm (177) of the pawl (162), said edge (189) being able to come into engagement with said release arm (177) when the manual actuation lever (164) is pivoted away from its rest position.

17. Heel unit according to claim 16, wherein said thrust member (185) has the shape of a semicylindrical flap and constitutes a closure for an opening between said base body (14) and said sole holder (16).

18. Heel unit according to claim 1, including a manual actuation lever (64) pivotally mounted on the base body (14) about the axis (A) of the return cam (26) and of the sole holder (16), said manual actuation lever being provided for pivoting said sole holder (16) at least in the opening direction.

19. Heel unit according to claim 1, including release means for the unidirectional blocking arrangement (60), and means for actuating said release means independently of a manual actuation lever (64) coupled to the sole holder (16).

20. Heel unit according to claim 1, including a manual actuation lever (64) coupled to the sole holder (16) for releasing the unidirectional blocking arrangement (60), at least one drive member (76) on the manual actuation lever (64) for driving the sole holder (16) with a delay in the opening direction after release of the unidirectional blocking arrangement (60), a spring coupling the manual actuation lever (64) and the sole holder (16) and holding the latter in a starting relative position in which the unidirectional blocking arrangement (60) is not yet released, the sole holder including at least one opening (78) and said driving member (76) engaging the at least one opening (78), the size of the opening being larger than a cross-section of the driving member (76) received in the opening (78) in a manner to thereby define the driving delay.

21. Heel unit according to claim 1, comprising a manual actuation lever (64) including a driving member (76) for releasing the unidirectional blocking arrangement (60), a blocking pawl (62') of the unidirectional blocking arrangement (60) covering an opening (78) through which the driving member (76) extends as far as, when the manual actuation lever (64) is urged in the opening direction by the driving member (76), the blocking pawl (62') is initially lifted from the bearing face (68), and the sole holder (16) is thereafter driven.

22. Heel unit according to claim 21, wherein the blocking roller (62") of the unidirectional blocking arrangement (60) comprises a roller-type unidirectional blocking arrangement (60") connected to the manual actuation lever (64) which is pivotable about the axis (A) of the return cam and of the sole holder and is coupled to the sole holder (16) by means of the spring member (74).

23. Heel unit according to claim 1, further comprising a release arrangement (64", 86, 102, 104) associated to the unidirectional blocking arrangement (60) and activated as a function of the rotary position of the sole holder (16), the release arrangement releasing said unidirectional blocking arrangement (60) in a forced manner when the sole holder (16) reaches a rotary position within a rotation range limited by a release position for the ski boot and by the opening position.

24. Heel unit according to claim 23, wherein said release arrangement (64", 86, 102, 104) comprises a release piston (86) which is guided on the sole holder (16) and biases the release lever (64"), the piston cooperating with a climbing ramp (102) provided on the base body (14) and with a partly cylindrical surface portion (104) of the base body (14) which follows said ramp and is concentric to the axis (A) of the return cam and of the sole holder.

25. Heel unit according to claim 1, wherein the return cam (26) urged by the first spring device (28) has a control surface (46) devoid of a culminating point so that the first spring device (28) constantly urges the return cam toward the starting position corresponding to the closing position independently of the actual rotary position of the return cam (26).

26. Heel unit according to claim 1, wherein the return cam (26) comprises a partly cylindrical portion (44) having a flat control surface portion (46) on which rests a piston-shaped supporting abutment (40) of the first spring device (28) when the return cam (26) is not urged by the sole holder (16).

27. Heel unit according to claim 1, including a tilting mechanism urging the sole holder (16) toward the opening direction separately from the return cam (26) as long as the sole holder occupies a rotary position between its opening position and a predetermined intermediate position; and wherein the tilting mechanism (106) urges the sole holder (16) toward the closing direction as long as the sole holder occupies a rotary position between its closing position and said predetermined intermediate position.

28. Heel unit according to claim 27, wherein the tilting mechanism (106) comprises a toggle mechanism.

29. Heel unit according to claim 28, wherein the toggle mechanism (106) comprises a spring housing (108), a spring (112) mounted in the latter, and a spring abutment (110, 118) axially slidably mounted in the spring housing (108).

30. Heel unit according to claim 29, wherein the spring housing (108) is pivotally mounted on the base body (14) about a transverse axis (G), and in that the spring abutment (110) is pivotally mounted on the sole holder (16) about a transverse axis (H).

* * * * *